US007316129B2

(12) United States Patent
Meguro

(10) Patent No.: US 7,316,129 B2
(45) Date of Patent: Jan. 8, 2008

(54) PENDANT

(76) Inventor: Takefumi Meguro, Room 302, Sasuga Building No. 2, 5-21-3 Ueno, Taito-ku - Tokyo (JP)

( * ) Notice: Subject to any disclaimer, the term of this patent is extended or adjusted under 35 U.S.C. 154(b) by 0 days.

(21) Appl. No.: 11/179,870

(22) Filed: Jul. 12, 2005

(65) Prior Publication Data

US 2006/0016217 A1 Jan. 26, 2006

(30) Foreign Application Priority Data

Jul. 22, 2004 (JP) ..... 2004-214579

(51) Int. Cl.
*A44C 5/00* (2006.01)
*A44C 7/00* (2006.01)

(52) U.S. Cl. ..... 63/13; 63/3

(58) Field of Classification Search ..... 63/13, 63/3

See application file for complete search history.

(56) References Cited

U.S. PATENT DOCUMENTS 238,318 A * 3/1881 Washburn ..... 63/13
249,201 A * 11/1881 Oliver ..... 63/12
398,126 A 2/1889 Brooks
421,433 A 2/1890 Rees
477,025 A 6/1892 Stern
483,214 A 9/1892 Gaynor
502,801 A 8/1893 Wodiska
512,835 A 1/1894 Mann
527,359 A 10/1894 Bonner
799,056 A 9/1905 Huber et al.
983,598 A 2/1911 Auerbach
4,220,017 A * 9/1980 Freeman ..... 63/15
4,265,098 A 5/1981 Wayne
4,977,757 A * 12/1990 Mesica et al. ..... 63/15
5,974,831 A 11/1999 Afuku et al.
6,006,547 A 12/1999 Bergagnini
6,167,726 B1 * 1/2001 Kremer ..... 63/31
6,293,128 B1 9/2001 Leufray-Simms
6,550,276 B2 4/2003 Frank
6,681,599 B2 1/2004 Meguro
6,766,657 B1 * 7/2004 Chien ..... 63/15.1
2005/0028555 A1 2/2005 Meguro

* cited by examiner

*Primary Examiner*—Flemming Saether
*Assistant Examiner*—David C Reese
(74) *Attorney, Agent, or Firm*—James E. Walton

(57) ABSTRACT

A pendant comprises a pedestal, an ornamental-piece hanging portion from which an ornamental piece is hung, and a chain-threading hole through which a chain is threaded. The pedestal includes a rolling member which rolls in a vertical direction smoothly. The wheel can be positioned within the pedestal, or adjacent an outer surface of the pedestal. The wheel rotates vertically (i.e., about an axis which is generally perpendicular to a plane of the pendant, and which is generally horizontal when the pendant is worn), thereby decreasing coefficient of friction between the connecting surface and the skin or the closing of the wearer. That is, when the pendant is worn, the wheel touches the skin and rotates in order to prevent the ornamental piece from turning up or down.

18 Claims, 6 Drawing Sheets

PENDANT

CROSS-REFERENCE TO RELATED APPLICATIONS

This application claims priority to Japanese Application No. 2004-214579 filed Jul. 22, 2004, and which is incorporated herein by reference.

STATEMENT REGARDING FEDERALLY SPONSORED RESEARCH OR DEVELOPMENT

Not Applicable.

BACKGROUND OF THE INVENTION

The present invention relates to a pendant comprising a hanging ornamental piece having jewels and the like.

Conventionally, pendants vary in types and shapes. A pendant usually consists of a necklace chain worn round the neck and an ornamental piece mounted with jewels such as diamonds and the like. The pendant is formed to have an annular ring through which a chain is passed or with a chain directly fixed to the ornamental piece at the opposite ends of the chain.

For example, FIG. 24 illustrates a side view of an ornamental piece 112 of a pendant 110 hung from a necklace chain 70 worn round the neck. As shown in FIG. 24, the ornamental piece 112 looks brilliant when the ornamental piece 112 is hung in a generally vertical direction and a jewel such as a diamond mounted on the ornamental piece 112 faces the front.

On the other hand, the applicant of the present invention applied for a patent on the pendant claimed in the Patent Application No. 2001-086471 as a novel type of personal ornament. FIGS. 25 and 26 illustrate a pendant 120 claimed in the Patent Application No. 2001-086471, which is incorporated herein by reference. In the pendant 120 mentioned above, a taper-shaped stable portion 124 is formed on a reverse surface of the pedestal 125 providing a chain-linking portion 123 for threading a pendant chain through at an upper portion and a hanging portion 132 providing a hanging hole 128 at a tip in the front and a curved portion 130 formed behind the ornamental piece.

The hanging hole 128 is a hole for swingingly hanging an ornamental piece 146 mounted with a jewel 144 fixed by a locking ring 142.

With the structure as mentioned above, the ornamental piece 146 can swing back and forth, right and left reacting to even a slight movement. Besides, the jewel 144 ideally reflects the light coming not only from the front but also from the back, thereby shining beautifully.

However, the ornamental piece 112 of a conventional pendant turns up and down while used, which impairs the beauty and usability of the pendant.

FIG. 27 is a schematic drawing illustrating a conventional pendant in the above-mentioned condition while used. FIG. 27(A) illustrates a preferable wearing condition of the pendant 112 hanging from the chain for a necklace 70, in which the entire reverse surface on the pedestal of the ornamental piece is in flat contact with, for example, a front part of a wearer's neck. However, when the skin of the wearer is moist with sweat, for example, on a hot summer day, the pendant 112 sticks to a certain point of the skin and is hindered from moving upward smoothly. Besides, when the necklace chain 70 is pulled upward further in response to the wearer's motion, an upper edge 113 of the pendant 112 is stuck and the pendant 112 is turned up as it is shown in FIG. 27(B).

On the contrary, when the ornamental piece of the pendant 112 sticks to a certain point of the skin and hindered from moving downward smoothly. Accordingly, the necklace chain 70 is slackened and a lower edge 114 of the pendant 112 turns down.

BRIEF SUMMARY OF THE INVENTION

It is therefore an object of the present invention to provide a pendant which looks attractive and is able to move upward or downward smoothly without turning up or down while used.

To solve the problems mentioned above, a pendant made in accordance with the present invention comprises a pedestal including an ornamental-piece hanging portion on which an ornamental piece is hung and a chain-threading hole through which a chain is threaded. The pedestal provides a rolling member which rolls smoothly in a vertical direction. The chain-threading hole can act as a pivot and a cavity in the pedestal enables the pedestal to act as a balancer in to keep a balance of weight between a front portion and a back portion of the pedestal generally equal when the ornamental piece is hung on the ornamental-piece hanging portion formed in the front portion of the chain-threading hole. The chain-threading hole, which as noted, acts as a pivot to keep a balance of weight between the front portion and the back portion, is disposed eccentrically in the pedestal when the ornamental piece is hung on the ornamental-piece hanging portion formed in the front portion of the chain-threading hole. In one illustrative embodiment, rolling member is a doughnut-shaped wheel disposed in at least one of the upper end, the lower end or the center of the pedestal.

In accordance with one aspect of the present invention, the pendant includes the pedestal comprising the annular ornamental-piece hanging portion on which the ornamental piece is hung and the chain-threading hole through which a chain is threaded, in which:

the chain-threading hole is opened and extends through a generally central portion of the pedestal, the ornamental-piece hanging portion is vertically rotatable and is disposed on an inner wall of the chain-threading hole, a cavity acting as a balancer is formed inside the pedestal, and the ornamental-piece hanging portion rotates around the inner wall of the chain-threading portion under its weight and is hung steadily in place when the pendant is hung on the chain threaded through the chain-threading hole.

In accordance with another aspect of the present invention, the pendant comprises the pedestal having the ornamental-piece hanging portion on which the ornamental piece is hung in the front, the chain-threading hole through which a chain is threaded, and a rolling member comprises two doughnut-shaped wheels, there being one wheel positioned on either side of the pendant. The rolling member rotates vertically so that the ornamental piece is hung steadily in place when the pendant is worn and the pedestal is hung on the chain threaded through the chain-threading hole.

In accordance with a further aspect of the invention, the pendant comprises the chain-threading hole through which a chain is threaded, a cover-shaped pedestal providing the ornamental-piece hanging portion on which the ornamental piece is hung, and the rolling member comprising the doughnut-shaped wheel which is vertically and rotatably disposed in a generally central portion of an inner space of the pedestal, in which the rolling member rotates vertically so that the ornamental piece is hung steadily in place when the pendant is worn and the pedestal is hung on the chain threaded through the chain-threading hole.

With the pendant of the present invention, the ornamental portion of the pendant moves upward or downward smoothly without turning up and down. Accordingly, problems that the beauty and the usability of the pendant are impaired can be avoided.

DETAILED DESCRIPTION OF THE INVENTION

Figure 27:
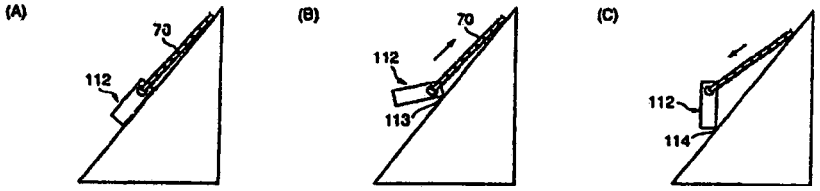
FIGS. 27(A) through 27(C) are side views of the conventional pendant showing examples of the pendant turning up and down.

Referring now to the drawings, preferred embodiments of the pendant of the present invention are described more particularly. Concrete examples showing how the pendant of the present invention prevents the pendant shown in FIG. 27 from turning up and down are illustrated in FIGS. 5 through 7.

Figure 5:
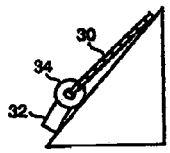
FIG. 5 is a side view showing a wheel of the pendant disposed on the top outside of the pendant.
Figure 6:
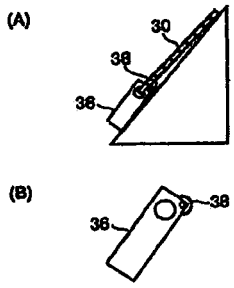
FIGS. 6(A) and 6(B) are side views showing the wheel disposed on the top inside of the pendant.

FIGS. 5 and 6 illustrate examples to solve the problems of the conventional pendant shown in FIG. 27(B) in turning up. That is, as shown in FIG. 5, wheels 34 provided on both sides at the top of a pendant 32 prevent the pendant 32 from turning up by rotating vertically in the event that a necklace chain 30 is pulled up. And FIGS. 6(A) and 6(B) are an example of movement and a side view of a wheel 38 disposed on the top inside of a pendant 36. As is the case for FIG. 5, the wheel 38 prevents the pendant 32 from turning up by rotating vertically in the event that a chain for a necklace 30 is pulled up.

Figure 7:
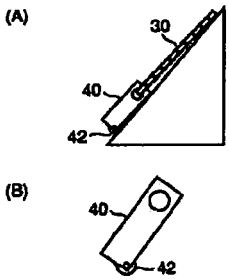
FIGS. 7(A) and 7(B) are side views showing the wheel disposed at the bottom inside of the pendant.

FIGS. 7(A) and 7(B) illustrate examples of the pendant of the present invention solving the problem of the conventional pendant shown in FIG. 27(C) in turning down. That is, as shown in FIG. 7, a wheel 42 provided on both sides at the bottom of a pendant 40 prevents the pendant 40 from turning down by rotating vertically in the event that the necklace chain 30 hangs down. Thus, a wheel-shaped rolling member covering an upper or lower edge or all over from the upper edge to the lower edge of the pendant can decrease coefficient of friction at the connecting surface in order to avoid the pendant from turning up or down.

Figure 8:
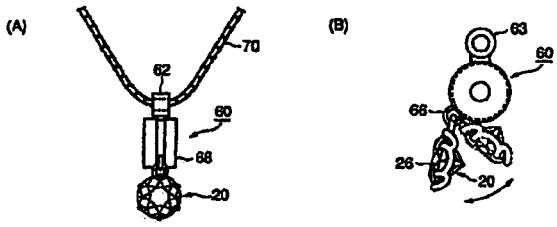
FIGS. 8(A) and 8(B) are front and side views of the a second embodiment of the pendant of the present invention.

FIGS. 1 through 4 show a first embodiment of the pendant of the present invention. FIG. 1(A) is a front view and FIG. 1(B) is a side view. A pendant 10 comprises a pedestal 12 formed of materials such as precious metal including gold, silver, platinum or brass and the like, an ornamental piece 20 mounted with a jewel such as diamond, emerald, ruby and the like, and a necklace chain 70 (refer to FIG. 8) formed of materials such as the precious metals mentioned above.

The shape of the pedestal 12 of the pendant has no specific limit. For example, the pedestal 12 can have the shape of a rectangle with two vertically longer opposing sides when viewed from the front and can be rounded off at the top corner. Alternatively, the pedestal 12 can be generally round in shape when viewed from the side and be provided with an opened chain-threading portion 18 for threading the necklace chain 70 through a width direction at an upper portion as shown in FIG. 1(B). An opening of the above-mentioned chain-threading portion 18 can be widened so that different type of necklaces can be passed through the chain-threading portion 18. For example, a necklace chain in larger diameter, a necklace of braided plural chains in small diameter, a pearl necklace and the like can be threaded through the chain-threading portion 18.

Figure 1:
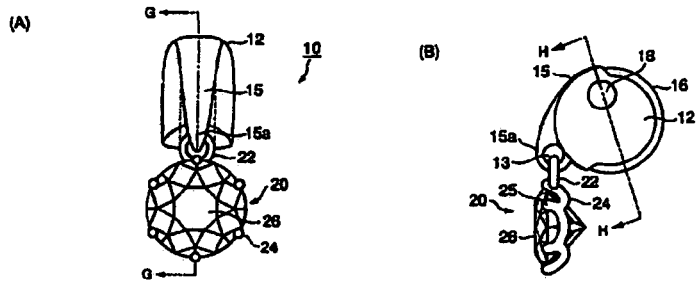
FIGS. 1(A) and 1(B) are front and side views of the pendant showing a first embodiment of the present invention.

Further, a hanging portion 15 for hanging the ornamental piece 20 is formed in the front of the pedestal. The hanging portion 15, as shown in FIG. 1, is formed generally in an inverted triangle when viewed from the front and a tip portion 15*a* is formed at the apex of the hanging portion. A hanging hole 13 for hanging the ornamental piece 20 is formed in the tip portion 15*a*. However, the shape of the hanging portion 15 is not limited within the above-mentioned shape as long as the ornamental piece 20 can be hung thereon.

The ornamental piece 20 is comprised of a jewel 26, a locking ring 24 for mounting the jewel 26 and an annular ring 22. The jewel 26 is firmly grasped by a plurality of claw portions 25 formed on the locking ring 24. The annular ring 22 is provided at the top of the locking ring 24 and is linked to the hanging hole 13 of the pedestal 12. The ornamental piece 20 can swing freely not only right and left but also back and forth, because sufficient space is provided behind the ornamental piece 20 even in the event of wearing the pendant round the neck. Therefore, the jewel 26 swings delicately back and forth, right and left and reflects the light which is not obtained in resting state, thereby shining beautifully.

The pedestal 12 includes a doughnut-shaped wheel 16. The wheel 16 is formed of, for example, similar metallic material to the pedestal 12 and rotates clockwise or counterclockwise, thereby decreasing coefficient of friction between the connecting surface and the skin of the wearer. That is, when the pendant 10 is worn, the wheel 16 touches the skin and rotates in order to avoid the ornamental piece 20 from turning up and down.

Figure 2:
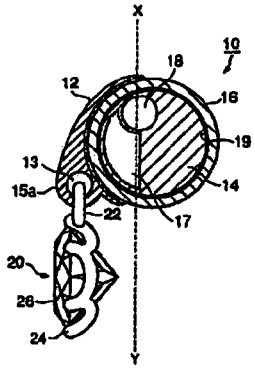
FIG. 2 is a partial cross-sectional view taken along the line G-G in the front view of FIG. 1(A)

FIG. 2 is a sectional view taken along line G-G of the front view of FIG. 1(A). As shown in FIG. 2, the base portion 14 surrounded by the wheel 16 which is circular in cross-section and has a surface 19 acting as a surface of an axis for rotating the wheel 16. In order for the wheel 16 to rotate smoothly, for example, a plurality of small bearings or the like can be provided on the surface 19 as required.

A cavity 17 is formed in the base portion 14. The cavity 17 acts as a balancer to equalize weights of the front and the back portions of the pendant 10 across a dotted line X-Y passing through the center of the chain-threading portion 18. Accordingly, when the chain for a necklace is threaded through the chain-threading portion 18 and the pendant 10 is hung, the weight of the fore part and the back part of the ornamental piece 10 is equalized on the dotted line X-Y and thereby hung stably at the front position as shown in FIG. 2. However, it is needless to say that the cavity 17 is not required if other means are used to adjust the weights of the fore and the back portions of the pendant 10.

Figure 3:
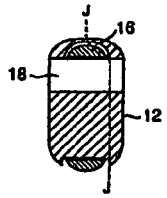
FIG. 3 is a cross sectional view taken on the line H-H in the side view of FIG. 1(B)
Figure 4:
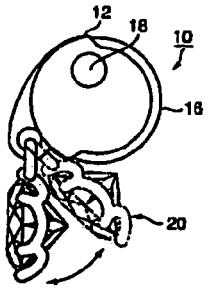
FIG. 4 is a side view showing movement of the ornamental piece of the pendant of FIG. 1.

FIG. 3 is a sectional view taken on along line H-H of FIG. 1(B). As shown in FIG. 3, the wheel 16 is semicircular in cross-section and provides a rounded outer surface which touches the skin when the pendant is worn and a flat surface fitting to the axis surface 19. And it is needless to say that the wheel 16 can be shaped in other shapes; for example, the wheel can have a flat cross-section. Incidentally, means for holding the wheel 16 in the pedestal 12 can vary. For example, the pedestal 12 can provide a construction in which the wheel 16 is inserted into the base portion 14 along the axis surface 19 coinciding with the dotted line J-J (FIG. 3) and all members are engaged with each other so as not to be separated.

FIGS. 8(A) and 8(B) are front and side views, respectively, of a second embodiment of the pendant 60 of the present invention. The pendant 60 includes a pedestal 62 which is formed of similar material to the pedestal 12 of the first embodiment of the present invention and, for example, can be rectangular in shaped when viewed from the front, circular when viewed from the side, and a disc over all. The pedestal 62 provides a chain-threading portion 63 for threading the chain 70 for a necklace at an upper edge. A hanging ring 66 to which annular ring 22 of the ornamental piece 20 is fixed is formed at generally the 8 o'clock position on the pedestal 62 relative to the chain-threading portion, as seen in FIG. 8(B). The pendant 60 also provides sufficient space behind the ornamental piece 20 in order for the ornamental piece 20 to swing back and forth, right and left, thereby making the jewel 26 shine beautifully with reflection.

A wheel 68 which is rotatable clockwise and counterclockwise is disposed on the outside of the pedestal 62. The wheel 68 has a similar function to the wheel 16 of pendant 10, namely to prevent the pendant from turning up or down.

Figure 9:
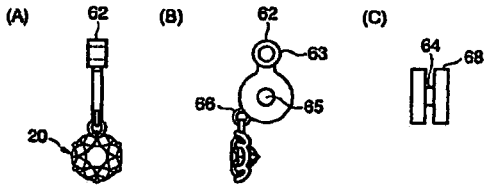
FIGS. 9(A), 9(B) and 9(C) are enlarged views of the pendant of FIG. 8, FIGS. 10(A), 10(B) and 10(C) are side views showing usage examples of the pendant of FIG. 8 in the event of changing the inclination.

FIG. 9 illustrates exploded views of the pendant 60, and more particularly FIGS. 9(A) and (B) are front and side views of the pedestal 62 and FIG. 9(C) is a front view of the wheel 68. A pivot hole 65 for passing a pivot 64 on which the wheel 68 turns freely is formed at the center of the pedestal 62. One side of the wheel 68 is removable from the pivot 64 so that the pivot 64 is passed through the pivot hole 65 and secured by engaging with the side of the wheel 68.

Figure 10:
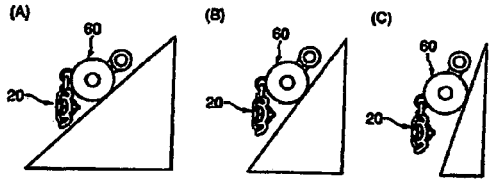

FIG. 10 illustrates side views showing usage examples of the pendant 60. The angle of slopes in FIGS. 10(A), (B) and (C) touching to the wheel 68 get larger in alphabetical order. As is shown clearly in FIG. 10, the ornamental piece 20 is hung vertically regardless of the angle of the slope. Particularly, the slope in FIG. 10(C) is the most similar to the slope presented during actual use, and, as seen, the ornamental piece 20 has sufficient space behind it, thereby enabling the jewel 26 to swing freely back and forth, right and left and to shine beautifully.

Figure 11:
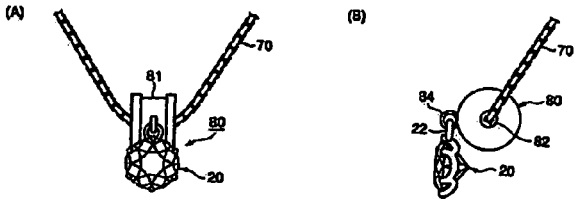
FIGS. 11(A) and 11(B) are front and side views of a third embodiment of a pendant of the present invention.

FIGS. 11(A) and 11(B) are front and side views, respectively, of a third embodiment of the pendant of the present invention. The third embodiment of the present invention is characterized in that an ornamental piece 80 allows a pedestal 81 to keep balance in a stable state at all times without providing a wheel as shown in the side view 11(B).

The pedestal 81 of the pendant 80 is shaped in a rectangle when viewed from the front, a circle when viewed from the side, and a disc over all and is formed of similar material to the pedestal 12 of the first embodiment of the present invention. A chain-threading portion 82 for threading the chain for a necklace extends axially through the center of the pedestal 81. A hanging ring 84 for hanging the annular ring 22 of the ornamental piece 20 is formed generally at the nine o'clock position in the pedestal 81.

Figure 12:
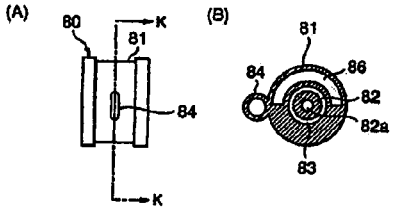
FIGS. 12(A) and 12(B) are front and cross-sectional views, respectively, of a pedestal of the pendant of FIG. 11; the cross-sectional view of FIG. 12(B) being taken along line K-K of FIG. 12(A), FIGS. 13(A) and 13(B) are side and cross-sectional views, respectively of the pedestal of the pendant of FIG. 11, the cross-sectional view of FIG. 13(B) being taken along line L-L of FIG. 13(A), FIGS. 14(A) through 14(C) are side views showing usage examples of the pendant of FIG. 11 in three different or changing inclinations.
Figure 13:
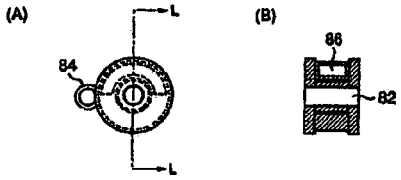

FIGS. 12(A) and 12(B) are a front view and a cross sectional view taken along line K-K of the pendant 80; and FIGS. 13(A) and 13(B) are a side view and a cross sectional view taken along the line L-L. As it is shown in the cross sectional views of FIGS. 12(B) and 13(B), an axis portion 82 is inserted along an inner wall 83 of a pedestal 81. The axis 82 enables the body 81 to rotate clockwise and counterclockwise and provides a chain-threading hole 82 perforated through the center of the pedestal 81 in order to thread the necklace chain 70 (refer to FIG. 14). A cavity 86 is formed above the inner wall 83. The cavity 86 keeps the hanging ring 84 in balance at the nine o'clock position. Up or down turning of the pendant is avoided by means of rotating the body 81 round the axis 82.

Figure 14:
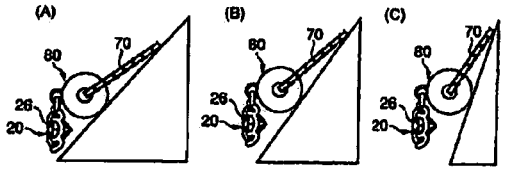

FIG. 14 illustrates side views showing usage examples of the pendant 80. The angle of slopes in FIGS. 14(A), (B) and (C) touching to the wheel 80 get larger in alphabetical order. As it is shown clearly in FIG. 14(A)-(C), the ornamental piece 20 is hung vertically regardless of the angle of the slope. Particularly, FIG. 14(C) is most nearly similar to the actual state of use, and the ornamental piece 20 has sufficient space at the back thereof, thereby enabling the jewel 26 to swing freely back and forth, right and left and to shine beautifully.

Figure 15:
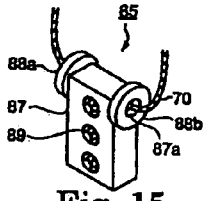
FIG. 15 is a perspective view of a fourth embodiment of the pendant of the present invention.
Figure 16:
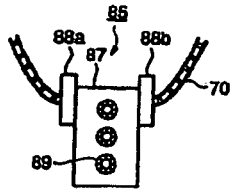
FIG. 16 is a front view of the pendant of FIG. 15 hanging from a chain.

FIGS. 15 and 16 illustrate a fourth embodiment of the pendant of the present invention. More particularly FIG. 15 is a perspective view and FIG. 16 is a front view of a pendant 85. The pendant 85 of the fourth embodiment comprises an ornamental piece 87, doughnut-shaped wheels 88*a* and 88*b*, and the necklace chain 70, in which every component is independent.

The ornamental piece 87 is formed of precious metals such as gold, silver, platinum and the like and shaped into a long and narrow square plate and mounted with jewels 89 such as three diamonds longitudinally. Additionally, a chain-threading hole 87*a* for threading the chain for the necklace 70 is formed at the top of the ornamental piece 87 and extends therethrough.

The doughnut-shaped wheels 88*a* and 88*b* are placed on both ends of the chain-threading hole 87*a*, with the pedestal 87 in between them. The above-mentioned wheels 88*a* and 88*b*, the chain-threading hole 87*a* and wheel 88*b* are connected to each other, and the necklace chain 70 threads through both wheels 88*a,b* and the hole 87*a*. The doughnut-shaped wheels 88*a* and 88*b* having a diameter greater than a thickness of the ornamental piece 87 and are formed of a material similar to that of the pedestal 12 as shown in the first embodiment and is rotatable about the necklace chain 70. The rotation of the wheels 88*a* and 88*b* prevent the ornamental piece 87 from turning up and down. Additionally, as the ornamental piece 87 of the present embodiment is shaped into a long narrow plate, the ornamental piece 87 hangs down without turning up and down. Incidentally, the above-mentioned shape of the ornamental piece 87, the kind of the jewel and the like are not specifically limited.

Figure 17:
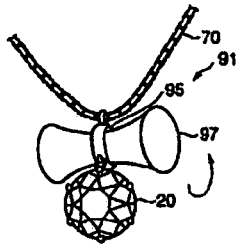
FIG. 17 is a perspective view of a fifth embodiment of the pendant of the present invention.

FIG. 17 is a perspective view of a fifth embodiment of the pendant of the present invention. The pendant 91 of the fifth embodiment comprises a ring-shaped pedestal 95 hanging an ornamental piece 20, a dowel shaped into an inward curved cylinder 97 rotatably inserted in the above-mentioned pedestal 95 and the chain for a necklace 70.

In the pendant 91, the dowel shaped into an inward curved cylinder 97 prevents the pedestal 95 from turning up and down by rolling vertically. Incidentally, the pedestal 95 and the dowel shaped into an inward curved cylinder 97 of the pendant 91 indicated in the present embodiment are formed of similar material to the pedestal 12 as indicated in the first embodiment.

Figure 18:
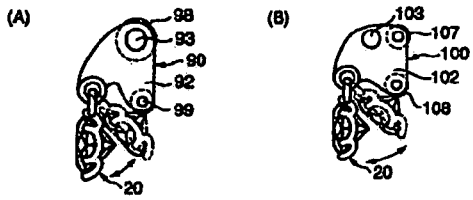
FIGS. 18(A) and 18(B) are side views showing a sixth embodiment (A) and a seventh embodiment (B), respectively, of the pendant of the present invention.

FIGS. 18(A) and (B) illustrate sixth and seventh embodiments of the pendant of the present invention, respectively. In the sixth embodiment (FIG. 18(A)) and the seventh embodiment (FIG. 18(B)), wheels provided on the upper and the lower portion of the pedestal prevent the pedestal from turning up and down.

An ornamental piece 90 is shown in the sixth embodiment (FIG. 18(A)) and hangs from a pedestal 92 in which wheels 98 and 99 are provided at the upper and the lower portion of the pedestal, respectively. The wheel 98 has a doughnut shape and is mounted rotatably on a periphery of the chain-threading portion 93 for threading a necklace chain.

An ornamental piece 100 is shown in the sixth embodiment (FIG. 18(B)) and hangs from a pedestal 102 in which wheels 107 and 108 are provided at the upper and the lower portion of the pedestal, respectively. In the ornamental piece 100, a chain-threading portion 103 for threading a necklace chain is located separately from the wheel 107 at the top of the pedestal.

Figure 19:
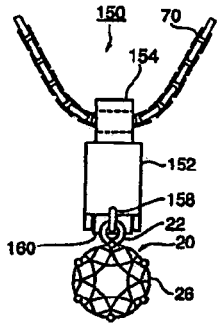
FIG. 19 is a front view of an eighth embodiment of the pendant of the present invention.
Figure 20:
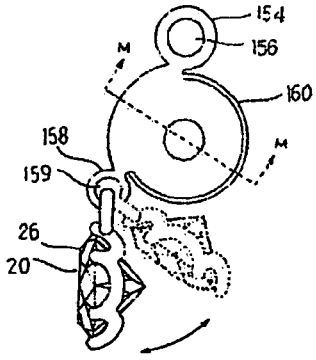
FIG. 20 is a side view of the pendant of FIG. 19.
Figure 21:
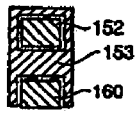
FIG. 21 is a cross-sectional view a wheel of the pendant of FIG. 19 taken along line M-M of FIG. 20, FIGS. 22(A) though 22(D) are explanatory views showing variations of the wheel disposed on the pedestal of the pendant of the present invention, FIGS. 23(A) though 23(D) are explanatory views showing variations in the placement of the wheels of the pendant of FIG. 19.

FIGS. 19 through 21 illustrate an eighth embodiment of the pendant of the present invention; and, more particularly, FIG. 19 is a front view; FIG. 20.,is a side view; and FIG. 21 is a cross-sectional view taken along the line M-M of FIG. 20. A pendant 150 of the eighth embodiment comprises a cover-shaped pedestal 152 formed of similar material to the first embodiment, the ornamental piece 20, and the chain for a necklace 70.

The cover-shaped pedestal 152 provides a body having an external view of a disc, a ring-shaped chain-threading portion 154 for threading the necklace chain 70 at the top of the body, and a hanging ring 158 for hanging the ornamental piece 20 at generally 8 o'clock position (relative to the chain threading portion 154) when view from a side, as seen in FIG. 20. The body of the pedestal 152, the chain-threading portion 154 and the hanging ring 158 are formed integrally. A hole 156 for threading the necklace chain 70 is formed in the chain-threading portion 154. The size of the hole 156 can be widened so that different type of necklaces (such as a chain for a necklace in larger diameter, a necklace of braided plural chains in small diameter, pearl necklace and the like) can thread through the hole 156.

Leaving sufficient space at the back, the ornamental piece 20 hung on a hole 159 of the hanging ring 158 can swing not only right and left but also back and forth when worn in the same manner as illustrated in the first embodiment shown in FIG. 1. Therefore, the jewel 26 swings delicately back and forth, right and left and reflects the light which is not obtained in resting state, thereby shining beautifully.

The cover-shaped pedestal 152 comprises a hollow body with an axis 153 formed inside and a doughnut-shaped ring 160 installed around the axis 153 (FIG. 21). The wheel 160 is formed of similar metallic material to the pedestal 152 and rotates vertically, thereby decreasing coefficient of friction between the connecting surface and the skin of the wearer. That is, when the pendant 150 is worn, the wheel 160 touches the skin or the clothing and rotates in order to avoid the ornamental piece from turning up and down. Incidentally, in order for the wheel 160 to rotate smoothly, for example, a plurality of small bearings or the like can be provided on the axis 153 as required.

In the eighth embodiment, the pendant 150 hangs on the chain 70 when worn, and the ornamental piece 20 is held at the 8 o'clock position by interactions of the hole 159 for threading the chain, an action of the wheel 160 and the touching surface. Therefore, the cavity 17 acting as a balancer in the first embodiment becomes unnecessary and the construction of the pedestal 152 is simplified, thereby serving for reductions in costs.

While the invention has been described in terms of several preferred embodiments, it will be recognize that the invention can be practiced with modification within the spirit and scope of the appended claims. That is, the present invention is to prevent the pendant from turning up and down by designing the shapes and arrangements of the wheel and balancer in the pedestal or the pedestal without the balancer.

Figure 22:
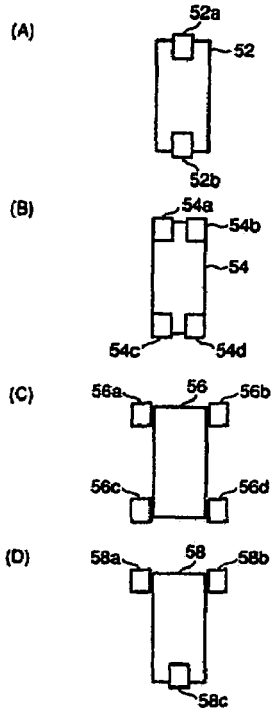

For example, FIG. 22 summaries representative combinations of the ornamental piece and the wheels installed therein for preventing the pendant from turning up and down. Incidentally, FIGS. 22(A) through (D) illustrate the pedestal viewed from the back where the wheel is installed touching the skin or the clothing.

FIG. 22(A) illustrates an ornamental piece 52 with two wheels 52*a* and 52*b* provided internally at the top and the bottom portions respectively, which corresponds to the fourth and the fifth embodiments. FIG. 22(B) illustrates an ornamental piece 54 which provides four wheels 54*a* though 54*d* internally at an upper and a lower portions on both sides so as not to come out therefrom. FIG. 22(C) illustrates an ornamental piece 56 which provides four wheels 56*a* though 56*d* externally at an upper and a lower portions on both sides. And FIG. 22(D) illustrates an ornamental piece 58 which provides two wheels 58*a* and 58*b* externally at upper positions on both sides and a wheel 58*c* internally at the bottom portion. Thus, methods of providing the wheels on or in the ornamental piece are varied. Such variations are intended to be within the scope of the present invention and the appended claims. Incidentally, as the jewel mounted on the ornamental piece, in addition to precious stones such as a diamond and color stones such as a ruby or an emerald, a coin, a pearl, a cameo, amber and the like are acceptable.

Figure 23:
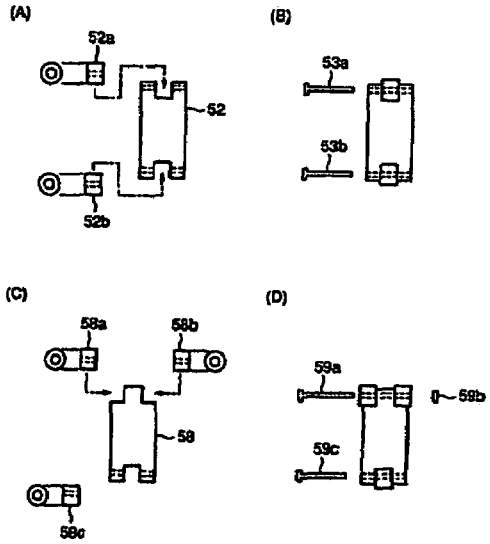
Figure 24:
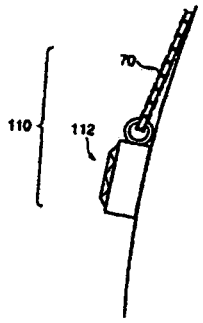
FIG. 24 is a side view showing a usage example of a conventional pendant.
Figure 25:
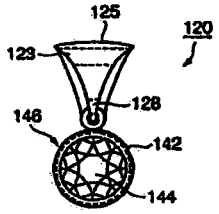
FIG. 25 is a front view showing the conventional pendant.
Figure 26:
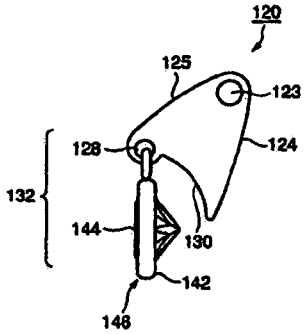
FIG. 26 is a side view showing the conventional pendant.

FIG. 23 is a structural diagram for illustrating how to mount the wheels on the pedestal. FIGS. 23(A) and 23(B) illustrate an example of mounting the wheels in the case of FIG. 22(A). Notch portions for installing the wheels 52*a* and 52*b* are provided at the top and the bottom portions on the back surface of the pedestal 52. The wheels are placed in the above-mentioned notch portions and pivoted horizontally by rivet-like members 53*a* and 53*b*.

Additionally, FIGS. 23(C) and 23(D) illustrate an example of mounting the wheels in cases of FIGS. 22(B) and 22(D) in combination. The wheels 58*a* and 58*b* are pivoted at the top portion of the pedestal by a rivet-like member 59*a* which is secured by a stop 59*b* located at the threaded (free) end. Thus, the wheels are mounted rotatably on the pedestal 58. The wheel 58*c* is pivoted by a rivet-like member 59*c* in a similar manner to the case of FIGS. 23(A) and 23(B).

The invention claimed is:

1. A pendant comprising a pedestal, an ornamental-piece hanging portion from which an ornamental piece is hung, and a chain-threading hole having a hole axis and being capable of having a chain threaded therethrough, wherein said pedestal includes a rolling member rotatable about a rolling member axis to enable said pendant to roll in a vertical direction smoothly, said rolling member extending around the hole axis of the chain-threading hole.

2. The pendant as claimed in claim 1, wherein said chain-threading hole acts as a pivot, said ornamental-piece hanging portion being forward of said chain-threading hole, and said pedestal having a cavity formed therein, whereby said pedestal acts as a balancer to keep a balance of weight between a front portion and a back portion of said pedestal, such that when said ornamental piece is hung on said ornamental-piece hanging portion said ornamental piece will hang generally vertically.

3. The pendant as claimed in claim 1, wherein said ornamental-piece hanging portion is forward of said chain-threading hole, and said chain-threading hole acts as a pivot to keep a balance of weight between a front portion and a back portion of said pedestal and is positioned eccentrically in said pedestal, such that when said ornamental piece is hung on said ornamental-piece hanging portion, said ornamental piece will hang generally vertically.

4. The pendant as claimed in claim 1, wherein said rolling member is a doughnut-shaped wheel disposed in at least one of an upper end, a lower end or a center of said pedestal.

5. The pendant of claim 1 wherein said pedestal is rotatable about said rolling member axis.

6. The pendant of claim 5 wherein said chain-threading hole is positioned generally centrally of said pedestal, said pivot axis being defined by said chain threading hole.

7. The pendant of claim 6 wherein said pedestal has a cavity formed therein, whereby said pedestal acting as a balancer is provided to keep a balance of weight between a front portion and a back portion thereof, such that when said ornamental piece is hung on said ornamental-piece hanging portion formed in the front portion of said chain-threading hole said ornamental piece will hang generally vertically.

8. The pendant of claim 5 wherein said rolling member defines a pivot axis for said pedestal.

9. The pendant of claim 8 wherein said rolling member is generally spool shaped having a generally centrally positioned opening defining said chain-threading hole; said pedestal is generally annular and being rotatable relative to said spool; said chain-threading hole defining an axis of both said rolling member and said pedestal.

10. The pendant of claim 8 wherein said chain threading hole is positioned rearwardly and above said ornamental-piece hanging portion.

11. The pendant of claim 10 wherein said chain-threading hole passes through said pedestal.

12. The pendant of claim 10 wherein said chain-threading hole is formed in a member extending from a periphery of said pedestal.

13. The pendant of claim 1 wherein said hole axis of said chain-threading hole is coaxial with the rolling axis about which said rolling member rotates.

14. The pendant of claim 1 wherein said hole axis of said chain-threading hole is nonconcentric with the rolling axis about which said rolling member rotates.

15. The pendant as claimed in claim 1 wherein the rolling member comprises a rolling-member hole through which the chain passes when threaded through the chain-threading hole.

16. The pendant as claimed in claim 1 wherein the ornamental piece is free to move relative to the pedestal.

17. A pendant comprising a pedestal having an ornamental-piece hanging portion on the front thereof from which an ornamental piece is hung, a chain-threading hole having a hole axis and being capable of having a chain threaded therethrough, and a rolling member comprised of doughnut-shaped wheels positioned on opposite sides of said pedestal, wherein said rolling member rotates about a rolling member axis, said rolling member extending around the hole axis of the chain-threading hole and being generally perpendicular to a plane of said pedestal so that said ornamental piece is hung steadily in place when the pendant is worn and the pedestal is hung on a chain threaded through said chain-threading hole.

18. The pendant as claimed in claim 17 wherein the rolling member comprises a rolling-member hole through which the chain passes when threaded through the chain-threading hole.

* * * * *